United States Patent [19]

McNiel et al.

[11] 4,406,319

[45] Sep. 27, 1983

[54] VENETIAN BLIND DRIVE CONTROL

[75] Inventors: Claude M. McNiel, Mission Viejo; Louis G. Valle, Huntington Beach, both of Calif.

[73] Assignee: Beatrice Foods Co., Denver, Colo.

[21] Appl. No.: 207,408

[22] Filed: Nov. 17, 1980

[51] Int. Cl.[3] ..... E06B 9/307

[52] U.S. Cl. ..... 160/177

[58] Field of Search ..... 160/174, 175, 176, 177; 64/29; 74/527

[56] References Cited

U.S. PATENT DOCUMENTS

| | | | |
|---|---|---|---|
| 2,688,857 | 9/1954 | Jones | 64/29 |
| 2,709,488 | 5/1955 | Lorentzen | 160/176 |
| 3,347,062 | 10/1967 | Schumann et al. | 64/29 R |
| 3,605,852 | 9/1971 | Vecchiarelli | 160/176 |
| 3,921,695 | 11/1975 | Debs | 160/177 |
| 4,306,608 | 12/1981 | Frentzel et al. | 160/176 R |
| 4,332,288 | 6/1982 | Frentzel et al. | 160/176 R |

*Primary Examiner*—Peter M. Caun
*Assistant Examiner*—Cherney S. Lieberman
*Attorney, Agent, or Firm*—George J. Netter

[57] ABSTRACT

A drive control apparatus interconnects with a venetian blind slat ladder assembly for positioning the blind slats at any desired angular relationship and includes a detent that is moved during slat positioning and when a limit stop is reached exerts a back pressure onto the drive apparatus. When the back pressure exceeds a predetermined amount, this causes the drive shaft to overcome a retarding leaf spring pressure and thereby slip rather than drive the slat ladders.

10 Claims, 12 Drawing Figures

FIG. 1.
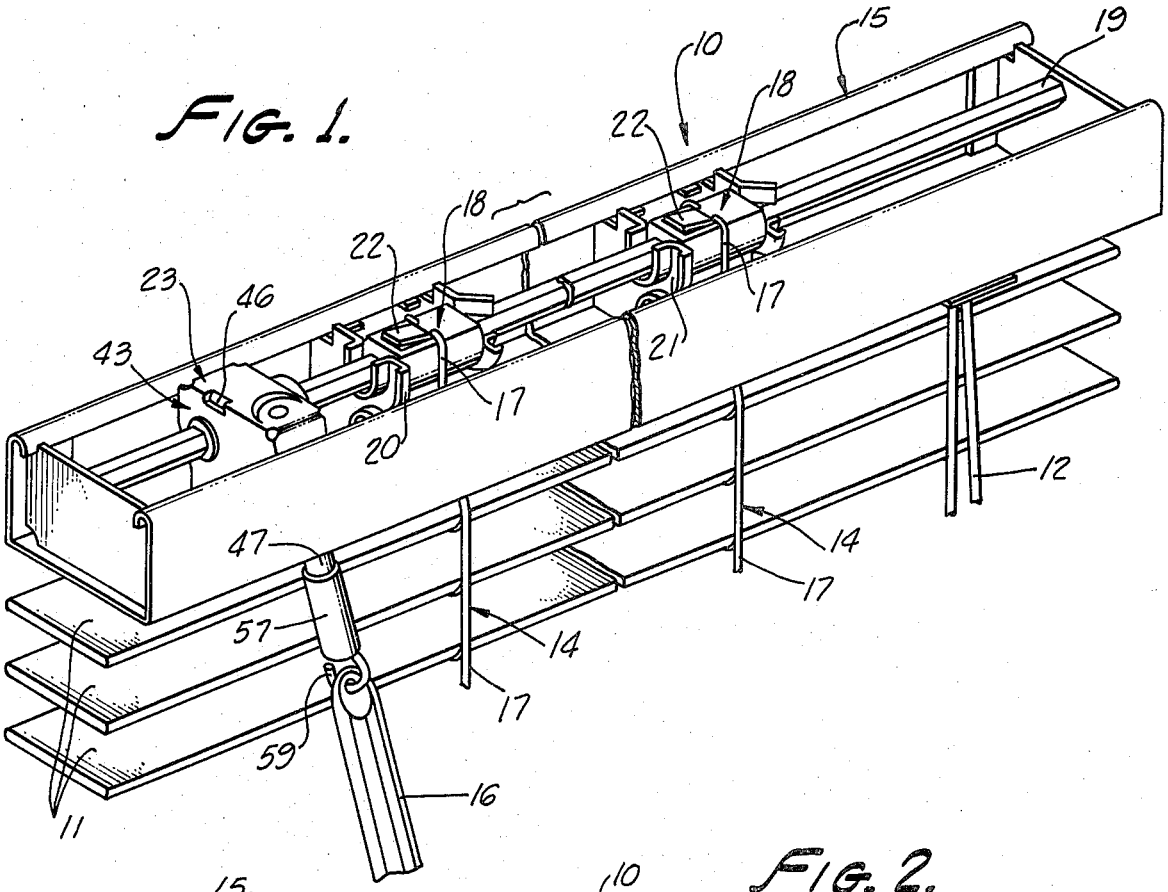
FIG. 2.
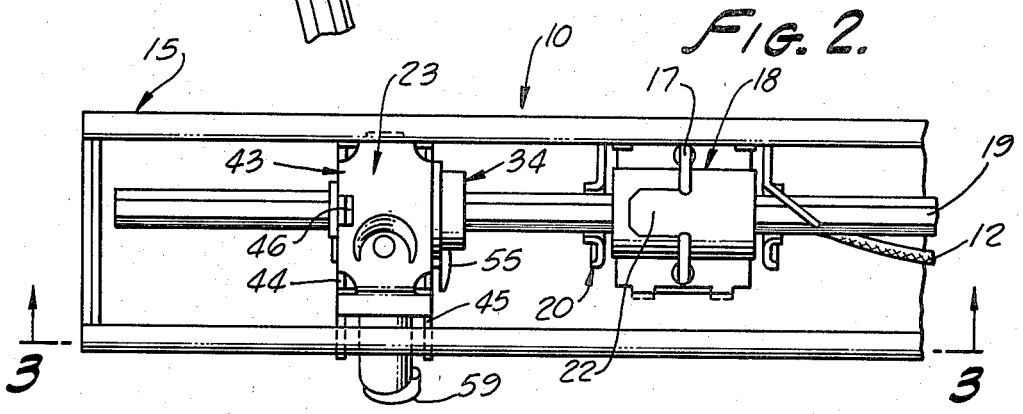
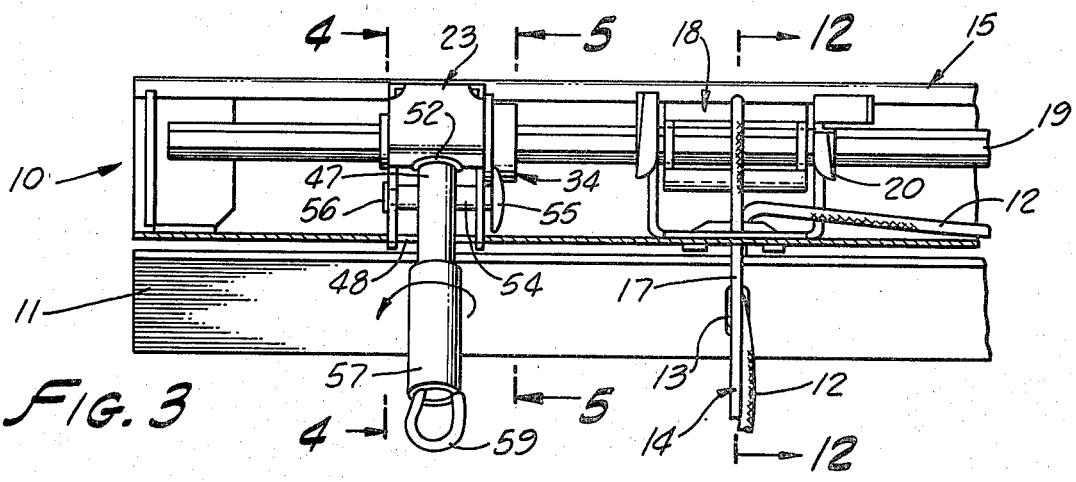
FIG. 3

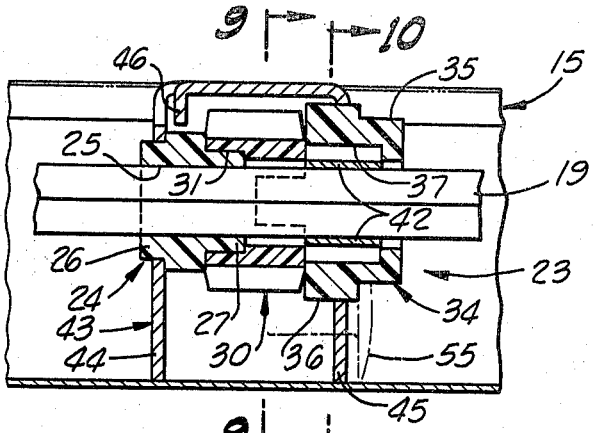
FIG. 8.
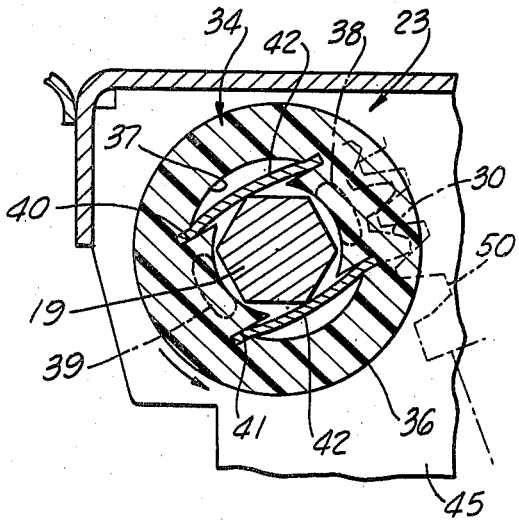
FIG. 11.
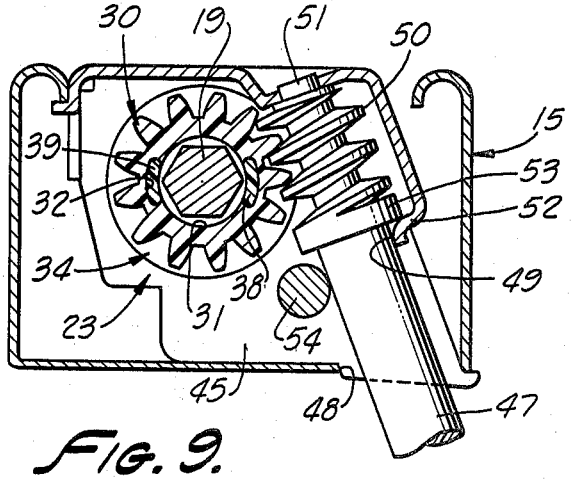
FIG. 9.
FIG. 12.
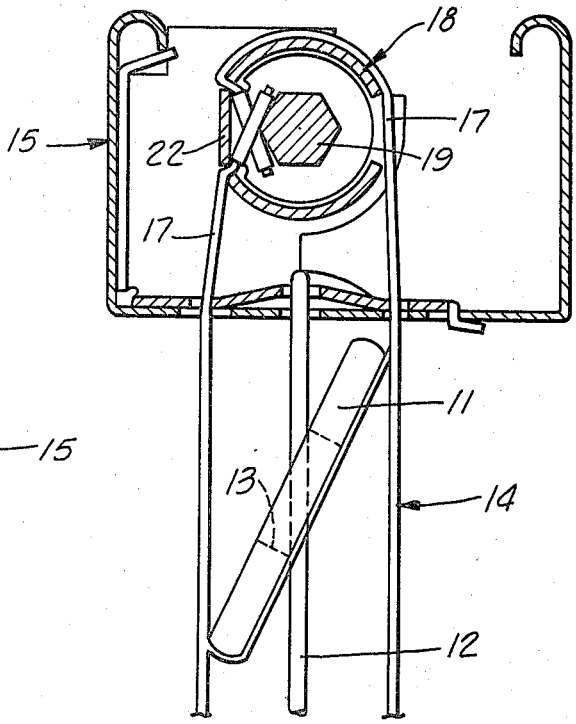
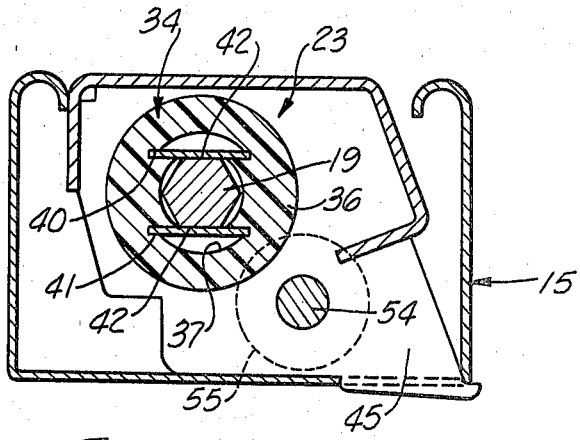
FIG. 10.

VENETIAN BLIND DRIVE CONTROL

The present invention relates generally to a venetian blind, and, more particularly, to a drive control for such a venetian blind to position the slats throughout a limited range of angular dispositions with an override means for the control when a range limit is exceeded.

BACKGROUND OF THE INVENTION

A venetian blind is a window covering unit having a plurality of vertically stacked, horizontally rotatable slat-like members constructed of wood, metal or plastic. The blind is provided with certain cords for raising the slats and ladders for tilting the slats to any desired angle to control the amount of light that can pass through the blind.

Although earlier in the art it was customary to adjust slat angle by hand manipulation of the ladders which interconnected with the slats, it is now customary to provide a single control lever or wand which is typically rotated about its longitudinal axis to perform the slat angle adjustment. It has also been customary for the slat angle control lever to be capable of being operated even after the slats had reached a maximum angular relationship which frequently resulted in destruction or impairment of the control lever mechanism. To prevent damage to the slat control apparatus as well as possible breakage of the ladders interrelating the slats, there are known devices to minimize or alleviate this problem by providing a relative complicated and expensive slip clutch arrangement, such that when the retarding force reaches a certain maximum the device can be operated further without driving effect on the slats and associated ladders.

SUMMARY OF THE INVENTION

In the practice of the present invention, there is provided a control drive apparatus interconnected with a venetian blind ladder assembly for positioning the slats composing the blind at any desired angular relationship. The drive apparatus includes a detent that is moved during slat positioning and when a limit stop is reached exerts a back pressure onto the drive apparatus. When the back pressure exceeds a predetermined amount, this causes a drive shaft to overcome a retarding leaf spring pressure and thereby slip rather than drive the slat ladders.

DESCRIPTION OF THE DRAWING

FIG. 1 is a perspective view of a venetian blind including the drive control of the present invention.

FIG. 2 is a top plan view of the blind of FIG. 1.

FIG. 3 is a partially fragmentary, front elevational sectional view taken along the line 3—3 of FIG. 2.

FIG. 8 is a sectional view through the drive control apparatus.

FIG. 9 is a cross-sectional view taken along the line 9—9 of FIG. 8.

FIG. 10 is a cross-sectional view taken along the line 10—10 of FIG. 8.

FIG. 11 is a sectional view similar to FIG. 10 showing the drive shaft and gear during slipping.

FIG. 12 shows the drive control and slat tilting cords.

DESCRIPTION OF A PREFERRED EMBODIMENT

Figure 4:
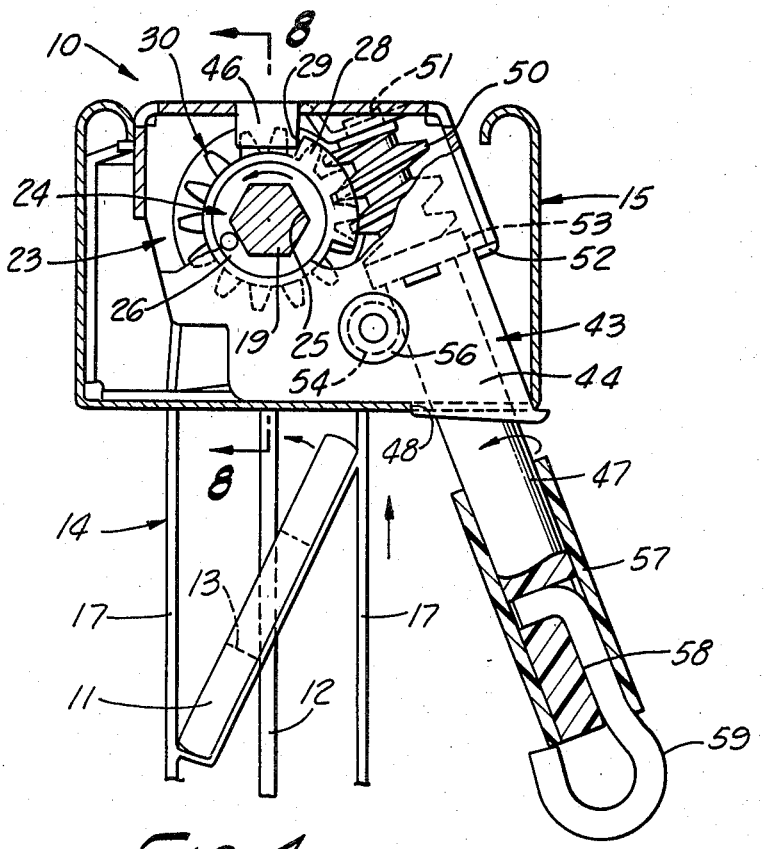
FIG. 4 is an end elevational sectional view taken along the line 4—4 of FIG. 3.
Figure 7:
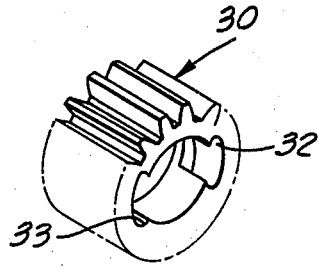
FIG. 7 is a perspective view partially in phantom of the worm wheel.

Reference is now made to the drawings and particularly FIGS. 1–3, where there is shown a venetian blind enumerated generally as at 10 with which the present invention is advantageously used. In its major elements, the venetian blind 10 includes a plurality of slat-like members or slats 11 supported in vertically spaced arrangement on cords 12 passing through aligned openings 13 in the slats at each side thereof and a further set of ladders 14 connected to the longitudinal edges of each slat and adjustable to control the angle of the slats with respect to each other thereby controlling the light and view through the blind. The blind is conventionally hung from a headrail 15 mounted conveniently adjacent the window and within which the various parts of the slat driving control apparatus to be described are located. A control lever or wand 16 extends outwardly of the cornice box for rotative adjustment to produce the desired slat angle.

Briefly, as to operation of the venetian blind, a downward force upon the outer ends of cords 12 the other parts of which extend through the openings 13 of the slats with the lower cord ends being connected to the lowermost slat, causes the slats to be raised upwardly and removed from obstructing light and view through the window. As can be seen best in FIGS. 2 and 3, the ladder 14 includes a cord 17 received over a rocker device 18 dividing the ladder cord into one half which is connected to one end of slat supports extending transversely under each slat (not shown) and a second half which extends down the opposite slat edges and interconnects with the other end of the slat supports. Rotation of the rocker device causes either the front or rear edge of the slats to be raised depending upon the direction of the rotation, with the opposite slat edge being lowered, the sum effect resulting in a change of the slat angle or tilt.

In a typical venetian blind there are two or more rocker devices 18 received on a drive shaft 19, the entire assembly being received within the headrail 15. The shaft 9 has a polygonal cross-section which is received within openings in the rocker devices of same geometry and dimensions forming a non-slip drive relation. First and second yokes 20 and 21 are mounted within the headrail closely adjacent the respective rocker devices for reducing or eliminating sag in the shaft. Each ladder cord 17 is received over a respective rocker device and frictionally secured under a tab 22. The drive control 23 to be described, also located within the headrail, is interrelated with the shaft 19 for converting rotation of the wand 16 to turning motion of the shaft 19 and thus modification of slat angle or tilt.

Figure 6:
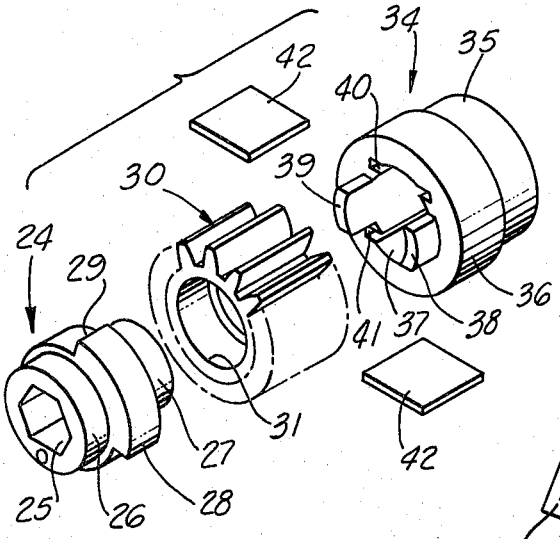
FIG. 6 is a perspective exploded view of the various parts of the slat angle drive control apparatus.
Figure 5:
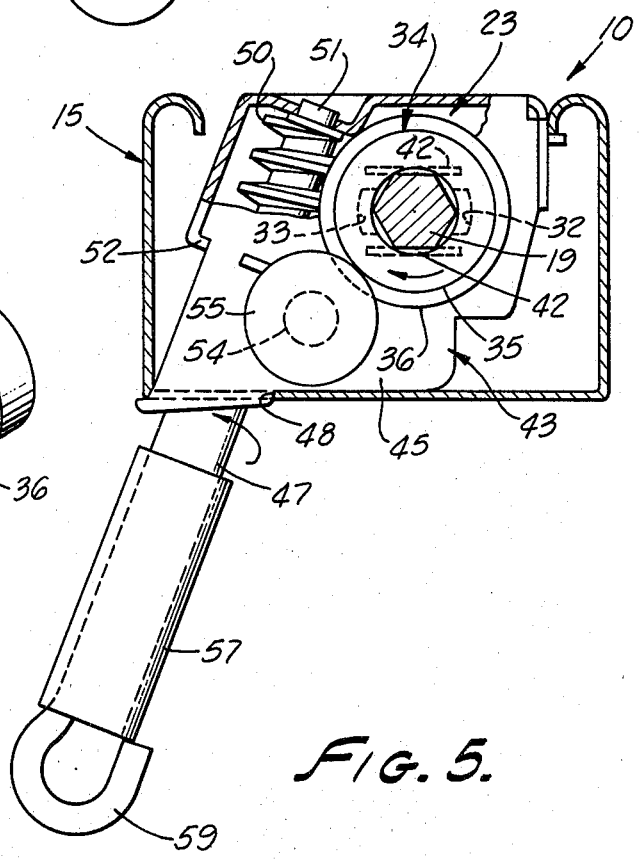
FIG. 5 is a sectional view taken along the line 5—5 of FIG. 3.

For the ensuing description of the details of the drive control 23, reference is first made to FIG. 6 showing various parts of the control in explode relation. An elongated detent or stop 24 includes an axial bore 25 of suitable polygonal shape and dimensions to enable fitting and non-rotating receipt on the shaft 19. First and second cylindrical hubs 26 and 27 form the two end portions of the detent. An enlarged diametral portion 28 extends circumferentially about the detent between the two hubs and for a predetermined angular extent. The limiting edges of the enlarged diametral portion 28 form shoulders 29 for a purpose and use to be described.

A worm wheel 30 has a set of gear teeth extending completely about its circumferential periphery and a circular bore 31 within which the detent hub 27 is rotatably received. It is to be noted that the hub 27 only extends partway into the gear bore leaving a substantial part free on the opposite side of the gear, the walls of which include a pair of diametrally opposed open key slots 32 and 33.

An override means 34 has a generally cylindrical body with a small diametral part 35 and an adjacent larger diametral part 36. An axial opening 37 extends competely through the means 34 and is of such diameter as to receive the shaft 19 freely therein. First and second keys 38 and 39 are integral with the larger diametral part 36 and extend outwardly from the end wall thereof immediately adjacent the side of the opening 37. The keys are of such dimensions and so located on the means 34 as to permit fitting receipt within the gear slots 32 and 33 making the worm wheel and means 34 unitary.

Arranged at 90 degrees to the keys 38 and 39 and parallely opposed to each other, are first and second rectangular slots 40 and 41 formed in the wall defining the opening 37 in override means 34. A pair of rectangular leaf springs 42 are respectively received within slots 40 and 41 with their major areal portions parallel to one another and spaced apart a distance equal to the thickness of the shaft 19 as measured between opposite flat sides.

The parts shown in FIG. 6 are all assembled within a housing 43 having opposite walls 44 and 45 containing aligned openings, through one of which the hub 26 of detent 24 extends and through the other opening the cylindrical hub 35 to override 34 extends. The walls 44 and 45 are so spaced as to hold the detent 24 with its hub 27 received within the gear bore 31 and the keys 38 and 39 of the override means within gear slots 32 and 33 all in a unitary manner. The inner wall surface of 44 includes an inwardly directed ear 46 which serves as a limit stop for the detent 24 by engaging the shoulders 29 and preventing further rotation in that direction.

A control shaft 47 extends through an opening 48 in the bottom wall of the headrail 15 and a similar opening 49 in the bottom wall of the drive control housing to terminate at its upper end in a worm 50 which meshes with the worm wheel 30. At the end of the worm there is provided a short stub shaft 51 which is rotatably received within an opening in the drive control housing top wall to serve as a journal bearing for the shaft 47 and worm. An inwardly directed ear 52 formed in the adjacent housing sidewall rides against a continuous raised shoulder 53 defining the inner end of the worm. A cylindrical rod 54 has its ends fixed in the housing walls, and extends across and in contact with the shaft 47 on the side opposite the ear 52 (FIG. 9). The rod 54 and ear 52 furnish a further thrust bearing and journal for the worm 50 holding it firmly throughout its full range of rotative operation.

As to detailed construction, the rod 54 is the shank of a rivetlike member having a large head 55 located outside the housing. As shown best in FIG. 3, the head 55 is pressed tightly against the edge margin of the larger diametral part 36 of the override means 34 holding it within the housing when the opposite end of the rod 54 is peened over as at 56.

With the detent 24, worm wheel 30, and override means 34 assembled as previously described (FIG. 8) and the worm 50 in place, the entire drive control 23 is received on the shaft 19 and positioned with control shaft lever 47 extending angularly downward and outward of the headrail 15. The drive control housing is secured to the headrail by any suitable means, such as parts of the housing extending through openings in the headrail lower wall and being bent to prevent their withdrawal.

The outer end of the control shaft 47 has a tubular member 57 telescopingly received thereon. An L-shaped slot 58 in the shaft 47 includes a hook 59 lockingly held in place by the tubular member. The wand or control lever 16 has an opening adjacent one end which coacts with the hook 59 (FIG. 1) enabling rotative adjustment of the shaft 47 and worm gear by merely rotating the wand 16.

As to operation of the drive control 23, rotation of the wand 16 causes the worm wheel 30 to rotate which by virtue of the keys 38 and 39 being located in slots 32 and 33 turns the override means 34. Rotation of the override means is transmitted to the shaft 19 to adjust the slat tilt or angle as has been described. The shaft 19 is effectively keyed to the detent 24 by the fit of the polygonal shaft surfaces to matching surfaces in opening 25 so that the detent rotates unitarily with the shaft. When the detent has rotated to the point that the leading shoulder 29 contacts the limit stop 46, further rotation in the same direction initiates production of a retarding force on the shaft 19. Still further rotation of the wand control 16 will increase this retarding force until it reaches a point at which this force is greater than the restraining force on the shaft 19 produced by the leaf springs 42 and the shaft will then slip past the springs as shown in FIG. 11. Accordingly, all adjustment attempts made by rotating the wand 16 after the predetermined limit is reached produce a slipping of the override means 34 about the shaft 19 which saves the ring gear and worm gear from impairment or destruction.

In the practice of this invention there is provided in the drive mechanism for venetian blind slat tilt adjustment a slip-clutch type of connection that prevents breakage or damage to the drive mechanism on override. The leaf springs 42 are substantially flat during normal drive (FIG. 10) and are in flush contacting relation with flat surface portions on the periphery of shaft 19. When the torsional force on the shaft exceeds that of the leaf spring restraining force the edges 60 of the shaft distend the springs outwardly allowing the worm wheel 30 and override means 34 to turn about the shaft as shown in FIG. 11, for example. By this construction, there is no need for adjustment of spring pressure and little, if any, reliance on friction for securement while driving the shaft 19.

Moreover, the detent 24 has two shoulders 29 which act as means for limit stopping for both directions of shaft rotation. The angular extent of the larger diametral portion 28 can be changed as desired to provide any desired amount of rotative drive. Still further, only one shoulder 29 may be provided so that a limit stop exists in one rotatative direction only.

I claim:

1. A venetian blind drive mechanism for using rotative power to adjust the blind slat tilt angle, comprising:

a shaft;

first gear means freely received on the shaft;

releasable spring means resiliently interconnecting the first gear means to said shaft such that the first gear means and spring means rotate with the shaft;

second gear means turned by said input rotative power and meshed with said first gear means; and means carried by said shaft for stopping rotation of said shaft beyond a predetermined point and producing back pressure on said shaft sufficient to release said spring means from interconnection with said shaft when the shaft is rotated past the predetermined point.

2. A venetian blind drive mechanism as in claim 1, in which the second gear means is a worm, and the first gear means is a worm wheel angularly meshed with the worm.

3. A venetian blind drive mechanism as in claim 1, in which the back pressure producing means is fixed to said shaft for rotation therewith and includes protruding means for engaging a stop at a predetermined point of rotation.

4. A venetian blind drive mechanism as in claim 3, in which said protruding means includes first and second surfaces for engaging the stop in the two respective directions of rotation.

5. A venetian blind drive mechanism as in claim 1, in which the releasable spring means includes a body member with an opening through which the shaft extends, said body member being interconnected with the first gear means, and a leaf spring received within the body opening and resiliently engaging the shaft.

6. A venetian blind drive mechanism as in claim 5, in which the shaft periphery includes a flat surface portion against which the leaf spring bears.

7. A venetian blind drive mechanism as in claim 5, in which the body includes a key which is received within an opening in the first gear means interconnecting the first gear means for common rotation on the shaft with the releasable spring means.

8. A venetian blind drive mechanism as in claim 1, in which the back pressure producing means is secured to the shaft for rotation therewith and includes protruding means for engaging a stop at a predetermined point of rotation of the back pressure producing means;

the releasable spring means includes a body member with an opening through which the shaft extends, said body member being rotatable in common with the first gear means, and a leaf spring received within the body opening resiliently engaging the shaft.

9. A venetian blind drive mechanism as in claim 8, in which the body includes key means received within openings in the first gear means interconnecting the first gear means for common rotation on the shaft with the releasable spring means.

10. A venetian blind drive mechanism as in claim 1, in which the back pressure producing means is secured to the shaft for rotation therewith and includes protruding means for engaging a stop at a predetermined point of the shaft rotation;

the releasable spring means includes a body member with an opening through which the shaft extends, said body member being rotatable in common with the first gear means, and first and second leaf springs received within walls defining the body member opening resiliently engaging respective first and second surface portions of the shaft periphery.

* * * * *